United States Patent [19]

Wicks

[11] 4,325,203

[45] Apr. 20, 1982

[54] PATIO DOOR AND WINDOW GUARD SYSTEM INVENTION

[76] Inventor: Jerome L. Wicks, 3401 Rockdale Ct., Baltimore, Md. 21207

[21] Appl. No.: 144,951

[22] Filed: Apr. 29, 1980

[51] Int. Cl.[3] ..... E06B 7/00

[52] U.S. Cl. ..... 49/57; 49/56

[58] Field of Search ..... 49/50, 56, 57

[56] References Cited

U.S. PATENT DOCUMENTS

| | | | |
|---|---|---|---|
| 1,629,541 | 5/1927 | Scholer | 49/56 X |
| 1,966,636 | 7/1934 | McGuinness | 49/56 |
| 2,043,835 | 6/1936 | McGuinness | 49/56 X |
| 2,668,729 | 2/1954 | Watters | 49/50 X |
| 3,738,061 | 6/1973 | Catalano | 49/50 |

*Primary Examiner*—Kenneth Downey

*Attorney, Agent, or Firm*—John F. McClellan, Sr.

[57] ABSTRACT

A guard system for preventing unauthorized entry through sliding patio doors and the like even when the glass is broken, while preserving unobstructed appearance when not in use, includes a set of vertical rods hung from a track secured across the inside top of the patio door to be protected, and extending past it to one side so all rods can be slid out of sight behind a customary patio door curtain, and apparatus holding the rods in spaced parallel relation to bar the patio door to intruders, this apparatus including a horizontal bar across the inside of the patio door midway up and securable at each end by quick attach-detach brackets; the horizontal bar has holes through it for holding the rods in position; a sill track runs across the patio door sill on the inside and prevents the bottom of the rods from being pushed inward; the rods can be pivoted and lifted for insertion into the horizontal bar; alternative modes of deployment are disclosed.

10 Claims, 7 Drawing Figures

PATIO DOOR AND WINDOW GUARD SYSTEM INVENTION

This invention relates generally to protective devices and specifically to physical bars to entry through doors and windows.

Today more than at any time in the history of the United States citizens are threatened with crimes of intrusion on real property as domestic economic conditions attendant to loss of historical U.S. influence with foreign energy producers worsen. Losses from violence to person and property extend to others not directly affected, in increased costs of insurance, higher taxes to support law enforcement organization, and worst of all perhaps in the necessity to sleep lightly with resultant toll in life and health from tension.

Patio doors of dwelling have proven particularly vulnerable to intruders but even so are standard features of new construction in homes and apartments.

Any attempt to bar patio door entry involves the conconsideration of glass cutting or glass breakage as a means of entry, and to the present it is believed that no system has been provided which at the same time bars entry by frame distortion and by glass destruction and at the same time which warns away would-be intruders but which is concealable when not in use.

Principal objects of the invention are to provide such a system, which not only, as said, warns would be intruders, bars entry through frame forcing and through glass destruction, and is concealable when not in use, but which also is quick, easy and positive in deployment and in retraction, is safe and durable, is economical and attractive in appearance, but also which can be easily installed by almost any homeowner without help and without any heavy lifting or other straining.

A further object is to provide a system as described which can be made of relatively lightweight and noncorrosive metal such as aluminum and which will, even so, delay a would-be intruder, who when gaining access through the patio door proper would still have the task of sawing through the system of this invention, making a prolonged and loud sound of sawing a ringing metal bar or rod.

In brief summary given for cursive description only and not as limitation the invention includes a vertical array of rods suspended from a track in a manner permitting sliding the rods to a side of a patio door or the like for retraction and fixing the rods across the door in horizontally spaced position by means of a bar member engaging the middle portions of the rods and a sill member holding the lower ends of the bars.

The above and other objects and advantages of this invention will become more readily apparent on examination of the following description including the drawings, in which like reference numerals refer to like parts:

FIG. 1 shows the guard system comprising the invention 10 concealed in part behind a curtain C and curtain rod R of the type conventionally provided at the interior face of a conventional patio door P.

Visible parts of the invention in this view include an overhead, horizontal track 20 affixed to the wall of the building above the patio door and behind the curtain rod, an "L" shaped bracket 22, called the "second" bracket, affixed to the wall W of the building about halfway up the patio door height, adjacent to the patio door opening, and an upwardly open track or sill track 24 along the floor F of the inside of the building marginally adjacent the patio door opening. None of these parts is visible from outside the patio door, and none is obtrusive from inside so that when the guard system is not deployed for use it is essentially invisible.

Figure 1:
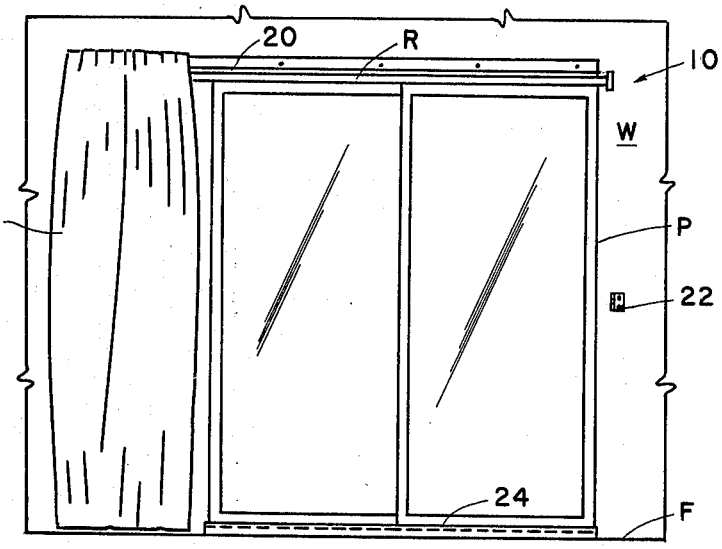
FIG. 1 is an elevational view of the interior side of a conventional patio door with curtain, the invention being installed but in retracted mode.
Figure 2:
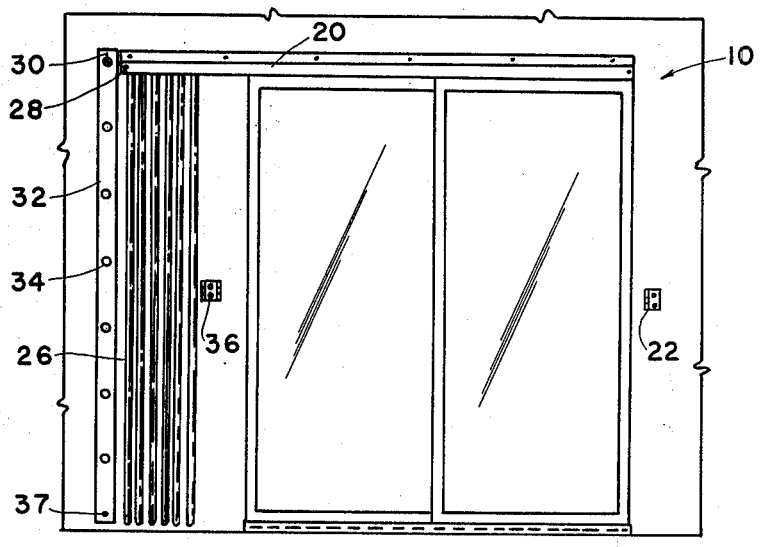
FIG. 2 is a view similar to the above but with the conventional curtain assembly removed to show the parts of the invention concealed by it.

FIG. 2 shows the same view as the above Figure but with the curtain and curtain rod removed, exposing the disposition of other parts of the invention 10 when retracted.

Hanging independently from the left end of the overhead track 20 is an array of vertical rods 26. In this nonuse position they may be compactly stored parallel and nearly in contact with each other clear of the patio door opening; the overhead track extends to one side (here the left side) of the patio door as a storage provision for the rods.

A stud 28 through each respective end of the overhead track prevents the rods from sliding too far and disengaging.

A hook 30 welded or otherwise conventionally affixed on the left end of the overhead track provides for storage by compact hanging of a perforate bar 32 parallel with the rods when the perforate bar is not in use. The perforate bar and attachments for it at the ends serve as means for detachably securing the respective middle portions of the rods in spaced succession across a patio door, when in use, as follows.

The spaced series of holes 34 in the perforate bar receive respective rods and secure them, the perforate bar then being held at the first end by a bracket 36 called the "first" bracket, and at the second end by the previously mentioned bracket 22. Holes 34 may be countersunk from either side to give them a universal action on the rods. Small hole 37 shown through the lower end of the perforate bar is for a locking pin, which is explained later.

Figure 3:
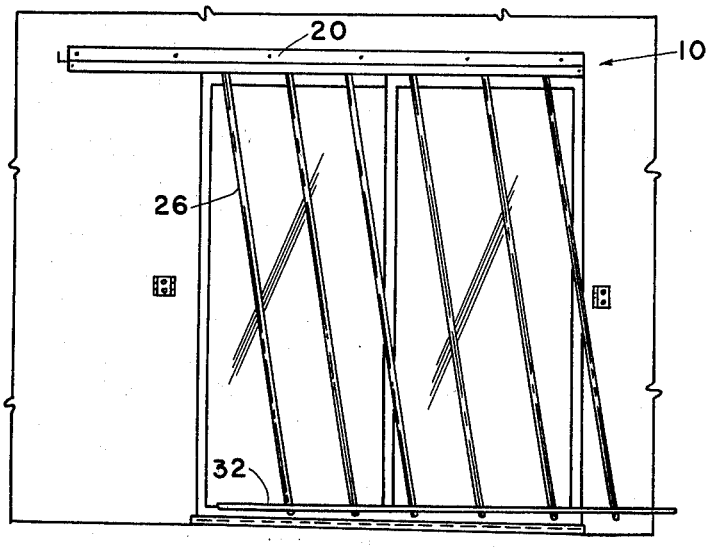
FIG. 3 is a similar view of a step of deployment of the invention for use.

FIG. 3 shows the invention 10 being deployed towards the use configuration in an optional mode of operation. Rods 26 have individually been slid along the overhead track 20 to the approximate position of use, and in a motion for assembly the lower ends have been swung rightward in pivotal motion about the points of attachment to the overhead track (the proportions of the overhead track permit this) sufficiently for installation of the perforate bar 32. The perforate bar has been installed by slipping it under the lower ends of the rods and raising it, engaging the holes in it with respective rods. The sill track throughout is proportioned for slidably receiving the lower or second ends of the rods.

Figure 4:
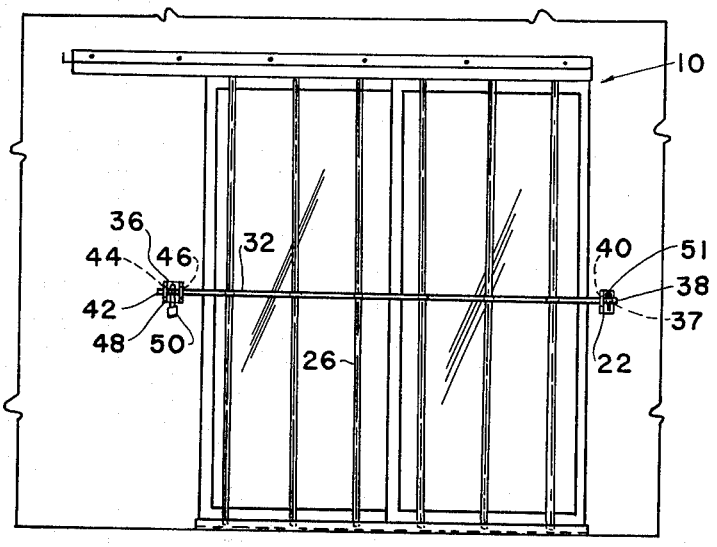
FIG. 4 is a similar view of the invention deployed for use and barring access through the patio door.

FIG. 4 shows the invention 10 installed in use position or final position, and locked, by the steps of raising the perforate bar 32, with the perforate bar in a horizontal orientation, moving it slightly to the left and then to the right to engage the right hand end with the hole 40 in the second bracket 22, and moving it then slightly to the right and then to the left to engage the left hand end 42 with the coaxial holes 44, 46 in the identical, 48, legs of "U"-shaped first bracket 36, after which any conventional padlock 50 is secured between the legs of the bracket and through the end-hole in the perforate bar. Finally, a locking pin 51 through small hole 37 further retains the end 38 of the perforate bar.

Installation is now complete, and an intruder would have to force or otherwise break the closure of the patio door and then saw through the structure of this invention to gain access, making considerable noise and caused considerable delay. Faced with this from outside the door, even a tool-equipped intruder would be likely to go elsewhere for quicker, more silent entry.

Figure 5:
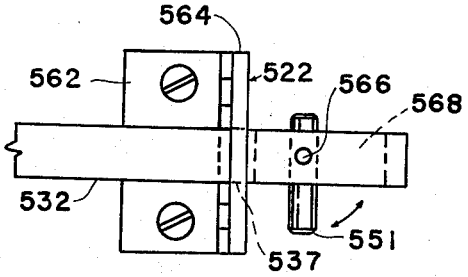
FIG. 5 is an elevational detail of an alternative pin arrangement.

FIG. 5 shows an alternate arrangement in that second bracket 522 is a hinge with one leaf 562 screwed to the wall and a second leg 564 foldable flat to the wall for safety when not in use. When in use the second leaf receives through hole 597 an end of the perforate bar 532. Retaining the end of the perforate bar may be a further option, a vertically transverse pin 551 pivoted offcenter at 566 in a longitudinal slot 568 in the perforate bar so that one end is heavier and it will automatically seek the vertical and bar the slot from sliding to the left, or the bracket from folding, by protruding above and below the bar, but when folded the pin fits fully in the slot.

Figure 6:
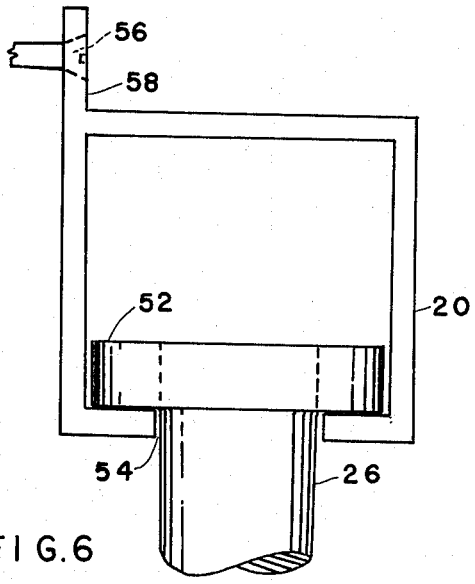
FIG. 6 is an enlarged elevational detail of rod hanging engagement with the overhead track in partially sectional elevational view.

FIG. 6 shows a fragmentary detail of engagement of a rod 26 with the overhead track 20, the means for slidably holding a first end of each rod. The rod has a "T" shaped top 52, (which may be a transverse cylindrical integral piece or disc with an axial hole receiving and retaining it as by welding) at the downwardly oriented opening 54 of the square "C" section of the track. Fit is such that the shape permits rotation of the rod and swing of the rod. Further, clearance above the disc permits axial rising of the rod a distance sufficient for each rod to be lifted and inserted into the sill plate in the alternative mode of deployment described below. The overhead track may be affixed to the walls by screws 56 through holes in a perforate flange 58 extending as a unitary part upward from the inner side of the squared "C" section shape.

Figure 7:
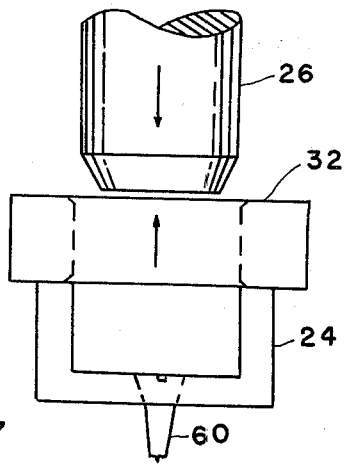
FIG. 7 is an enlarged elevational detail of the sill track with rod for engagement in it.

FIG. 7 shows a suitable proportional size relation of the sill track 24 and rods 26 and perforate bar 32. The rod 26 is being axially lifted and installed in the sill track 24 as described above through the perforate bar which is then lifted (arrows). Securance of the perforate bar may be as described above in either mode. The sill track may be affixed to the floor by screws 60.

It will be appreciated that a third mode of assembly can be by laying the bar along the inner side of the sill track and then lifting and swinging the rods into the holes, followed by raising the horizontal bar into position atop the sill track and individually lowering the rods into the sill track.

The assembly may have hard tempered, high strength 606 Tl aluminum rods 0.625 in. (16 mm) in diameter, and of a length to suit the installation, usually about 81 in. (2 m) long. The perforate bar may be $\frac{1}{2}$ in. (12 mm) by $1\frac{1}{3}$ in. (32 mm) in cross section and of similar material and one foot (30 cm) longer than the door preferably. The tracks may be of 0.190 in. (5 mm) wall thickness aluminum, and the brackets may be of similar material.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for guarding patio doors and the like against intrusion therethrough, said doors having interior and exterior faces, comprising: a plurality of rods having first and second ends, means for slidably holding said first end of each rod above a patio door interior face with each said rod depending vertically from the means for slidably holding; means for detachably securing respective middle portions of said rods in spaced succession across a said patio door, means for slidably receiving a said second end of each rod along a sill of a said patio door and preventing said second end from being pushed inward or outward relative to a said patio door; said means for slidably holding including an overhead track and a portion of each rod shaped for engaging the overhead track, the means for detachably securing including a detachable bar with a plurality of longitudinally spaced perforations therein for respectively receiving when in a horizontal position each of said plurality of rods in one of said perforations and sliding up said rods to said rod middle portions; and the means for slidably receiving comprising an upwardly open track for installation along the lower inside margin of a patio door opening in parallel spaced relation with said overhead track.

2. A system as recited in claim 1, said detachable bar having first and second ends, means for detachably fixing the detachable bar across a patio door including a first bracket with an opening therein for receiving a first end of the detachable bar, means for attaching the first bracket to a wall and first means for locking the first end of the detachable bar in the first bracket, the first bracket having arms in "U" shape and the first means for locking positionable between the legs of said "U" shape and engaging a said perforation in said detachable bar.

3. A system as recited in claim 2, the means for detachably securing including a second bracket, means for attaching the second bracket to a wall and a second means for locking the second end of the bar in an opening in the second bracket, the second means including a pin, means pivotally mounting the pin in a slot in the detachable bar proximate an end of the pin so that when the detachable bar is in said horizontal position the pin hangs vertically in the slot with respective portions of the pin protruding above and below the detachable bar and preventing the second end of the detachable bar from passing through said opening in the second bracket, and the slot proportioned for containing the pin longitudinally therealong and permitting the second end of the detachable bar to pass through said opening in the second bracket.

4. A system as recited in claim 3, the second bracket being "L" shaped and having a hinge permitting it to be folded flat against a wall when not in us.

5. A system as recited in claim 1, said overhead track being in square-"C" shape with the opening downward, and an upward flange on the overhead track with a plurality fo holes for attaching the overhead track to a wall.

6. In a system as recited in claim 5, said shaped portion of each rod being a disc shape, with the remainder of the rod extending axially therefrom.

7. A system as recited in claim 1, the fit of said portion of each rod portion with said overhead track being such as to permit a swinging motion about said rod portion for assembly in addition to said sliding.

8. A system as recited in claim 7, said motion for assembly including an axially upward motion of each rod sufficient to clear said upwardly open track and the thickness of said detachable bar when said detachable bar is laid on said upwardly open track.

9. A system as recited in claim 1, and means for hanging said detachable bar parallel with said rods when detached for storage.

10. A system as recited in claim 9, and means for concealing all said rods and detachable bar in storage mode clear of a said patio door opening comprising the overhead track proportioned for extending past a patio door to one side, and a curtain for installation as a patio door curtain in position covering the overhead track extension.

* * * * *